US005259692A

United States Patent [19]

Beller et al.

[11] Patent Number: 5,259,692

[45] Date of Patent: Nov. 9, 1993

[54] GROUND BREAKING APPARATUS

[76] Inventors: Larry D. Beller, P.O. Box 444, Homer, Ak. 99603; Douglas S. Hart, P.O. Box 99611, Kenai, Ak. 99611; Robert White, P.O. Box 58573, Fairbanks, Ak. 99711

[21] Appl. No.: 940,982

[22] Filed: Sep. 4, 1992

[51] Int. Cl.[5] ..... E01C 23/12

[52] U.S. Cl. ..... 404/90; 241/101.7; 299/39

[58] Field of Search ..... 299/39, 40; 404/90, 404/91; 241/101.7

[56] References Cited

U.S. PATENT DOCUMENTS

| | | | |
|---|---|---|---|
| 3,602,444 | 8/1971 | Meyer | 241/190 |
| 4,355,670 | 10/1982 | Ohrberg et al. | 241/101.7 X |
| 4,637,753 | 1/1987 | Swisher, Jr. | 404/90 |
| 4,704,045 | 11/1987 | Taylor et al. | 404/90 |
| 4,785,560 | 11/1988 | Hanson | 299/76 X |
| 4,848,677 | 7/1989 | Rayner | 241/79.1 X |

*Primary Examiner*—David J. Bagnell

*Attorney, Agent, or Firm*—Flehr, Hohbach, Test, Albritton & Herbert

[57] ABSTRACT

An earth working apparatus comprising a wheeled vehicle capable of traversing the ground and a ground breaking assembly mounted on the front end of such vehicle, such ground breaking assembly comprising a cylinder mounted for movement with the vehicle and for rotation about its cylinder axis, such cylinder having teeth projecting from its cylinder surface; the ground breaking assembly also having a shield partially surrounding the cylinder and provided on its inner surface close to the cylinder with fracture boards against which large pieces of pavement, frozen earth or stone impact, thereby causing such large pieces to fragment.

3 Claims, 4 Drawing Sheets

GROUND BREAKING APPARATUS

BACKGROUND OF THE INVENTION

There are presently available as heavy-duty ground working machines, rotary mills or profilers which are used to cut and pulverize hard ground surfaces and materials, such as asphalt surfaces, frozen ground, rock outcropping, and the like. These machines generally comprise a massive cylindrical roll with teeth protruding from the cylindrical surface thereof, and they are very effective for the purpose for which they are intended. However, such machines are extremely expensive and, unless they are needed and used on a regular basis, it is difficult for some road contractors and the like to justify the cost of acquiring one.

Most road contractors do have available, other types of ground-working equipment, such as loaders, graders and scrapers that have the load-carrying capacity to handle the cutting roll of such rotary mills. However such equipment generally does not have the power capacity to both drive the rotary mill for cutting and pulverizing the surface and propel the vehicle.

OBJECTS OF THE INVENTION

It is the object of this invention to provide an attachment that may be mounted on an existing carrier vehicle, such as a loader, grader, or the like to perform the function of a rotary mill.

It is a further object of this invention to provide a rotary mill attachment for a carrier vehicle, which can be quickly and easily mounted to operate effectively in either forward or reverse direction of travel.

It is a further object of this invention to provide a rotary mill attachment for a road-working carrier vehicle, which is self-powered to cut hard ground surfaces.

It is a further object of this invention to provide a rotary mill attachment for a load carrier vehicle which is capable of easily converting the carrier vehicle from normal ground-working equipment to a rotary mill and then reconverting back to normal use.

Other objects and advantages of this invention will become apparent from the description to follow, particularly when read in conjunction with the accompanying drawings.

SUMMARY OF THE INVENTION

In carrying out this invention, a conventional piece of earth working equipment, such as a front loader, grader or the like may be converted to a rotary mill by removing the bucket, forks or cutting attachment from the lifting arms and replacing it with an inverted shell cowling that is then supported on the lifting arms by heavy brackets. On the cowling are heavy mounting flanges, to which are secured side mounting plates for the mill roll. Within the cowling are breaker plates so positioned that they prevent large pieces of rock, pavement or frozen soil from passing through unchanged and which serve to fragment such large pieces. A massive, cylindrical mill roll with teeth around the surface thereof is rotatably mounted between the side mounting plates, and contained within the cylindrical roll at each end is a hydrostatic drive, which may be driven by fluid under pressure supplied from pumps driven by an auxiliary engine mounted on the carrier vehicle. The carrier vehicle may be converted back to its original earth-working function simply by removing the milling attachment and mounting the bucket or scraper, as originally provided.

BRIEF DESCRIPTION OF THE DRAWINGS

The accompanying drawings, which are incorporated in and form a part of this specification, illustrate embodiments of the invention and, together with the description, serve to explain the principles of the invention.

DETAILED DESCRIPTION OF THE PREFERRED EMBODIMENT

Figure 1:
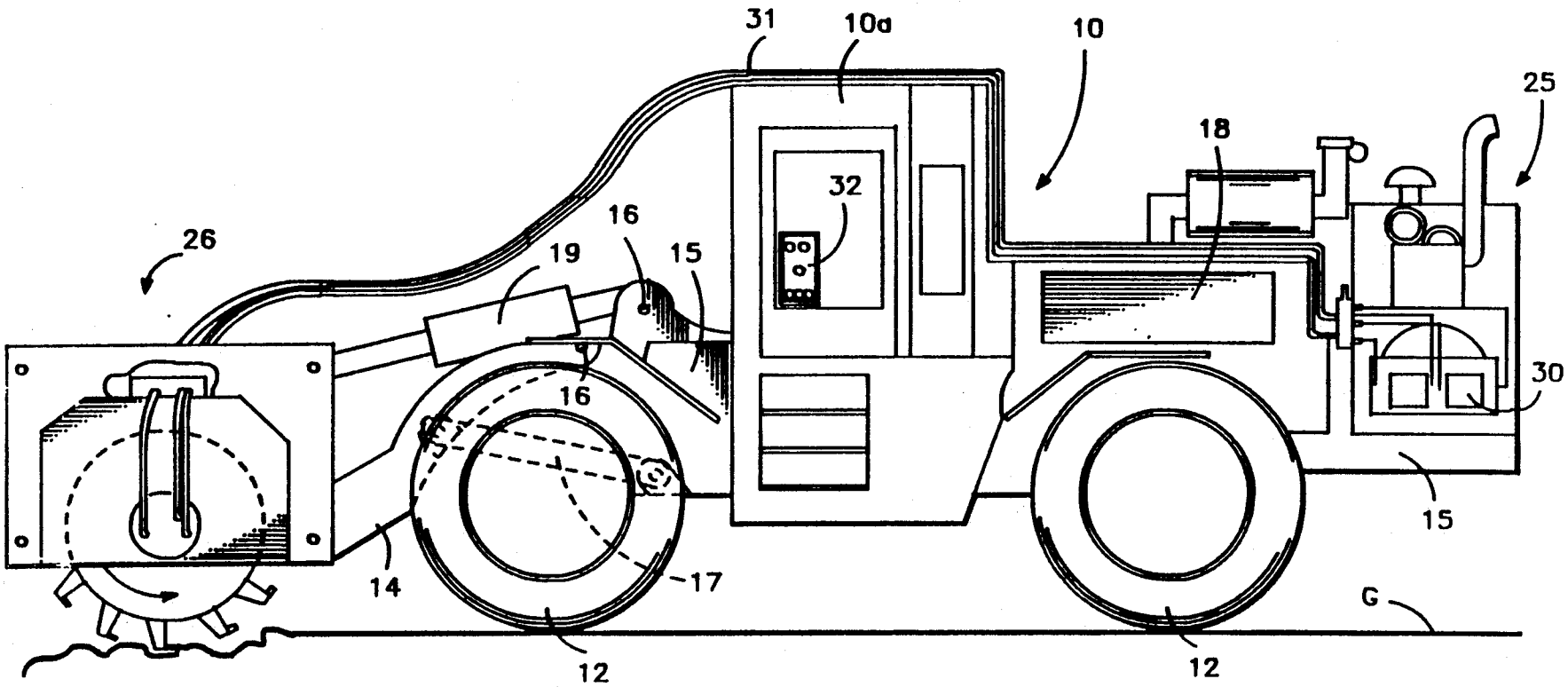
FIG. 1 is a side elevation of a ground-working equipment converted to use a rotary mill.

Referring now to the drawings, there is shown in FIG. 1 a ground-working equipment 10 such as a front loader which is mounted on wheels 12 to be propelled over the ground G for purposes of working or altering the surface. The loader 10 has a pair of arms 14 (one of which is shown in FIG. 1) pivoted on the frame 15 of the machine at 16 and lifted and lowered by hydraulic rams 17, one of which is shown, pivoted on the frame and on the arms as shown. The loader 10 is driven by suitable means such as a diesel engine 18, which also powers hydraulic rams 17 and 19 through suitable pumps and hydraulic lines (not shown).

In order to convert the loader (or other road-working equipment) to a rotary mill in accordance with this invention, an auxiliary engine 25 is mounted in a suitable location on the vehicle frame, as at the rear, and the rotary mill attachment 26 of this invention is mounted on the pivoted arms 14 at the front. The engine 25 drives hydraulic pumps 30 to deliver pressurized fluid through lines 31 to the rotary mill attachment 26 under control of a pilot panel 32 in the cab 10*a* of the carrier vehicle 10.

Figure 2:
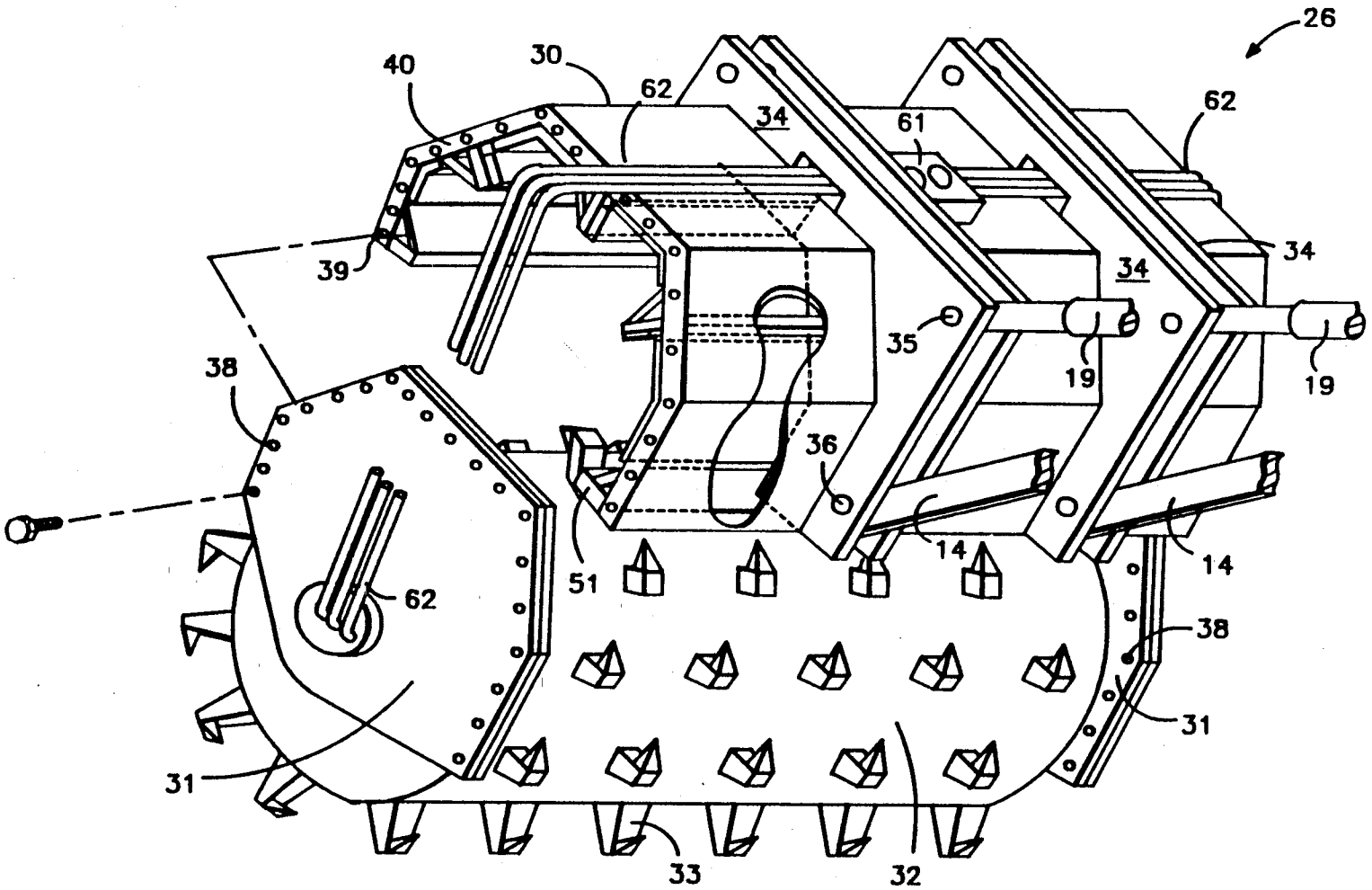
FIG. 2 is an exploded view of the rotary mill attachment of this invention.

Referring now more particularly to FIG. 2, the conventional loader, or other earth-moving equipment, is converted to a rotary trimmer and pulverizer by removing the conventional bucket or scraper (not shown) and replacing it with the massive cylindrical cutter roll and pulverizer 26 of this invention.

The cutter roll and pulverizer 26 comprises an inverted shell 30 to which end plates 31 are attached and a cylindrical roll 32 to which teeth 33 are attached and which can be removed and replaced when broken or worn. The shell 30 has generally the shape of an inverted U and is made of steel and it is braced by double braces 34 which are welded to the shell. Hydraulic rams 19 and arms 14 are pivotally connected at 35 and 36 to the braces. Holes are provided at 38 in the plates 31 and at 39 in flanges 40 of the ends of the shell, by which the end plates and the shell are bolted together.

Figure 4:
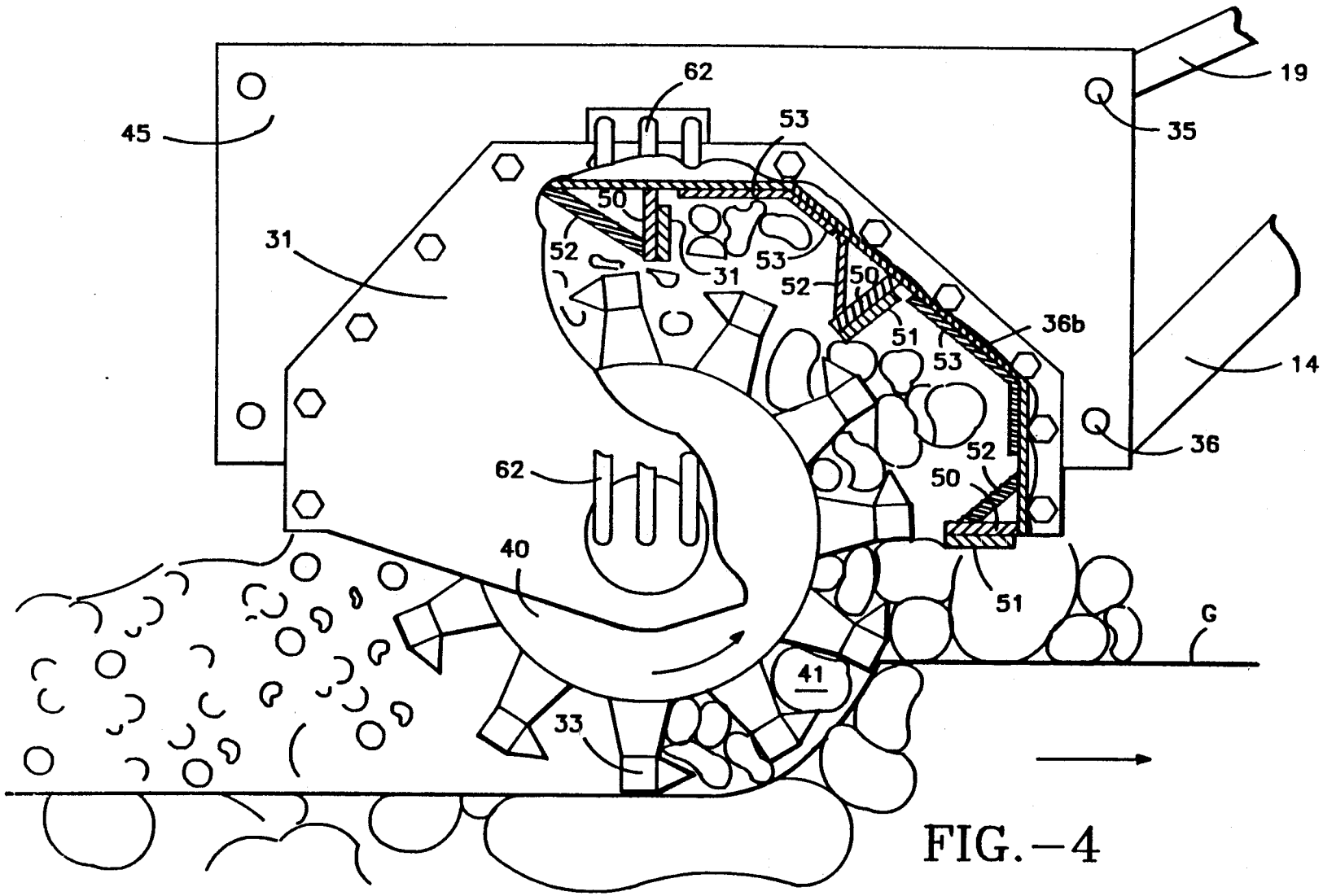
FIG. 4 is an end view partly broken away showing how the breaker plates fragment the soil.

Referring now to FIGS. 2 and 4, the interior of the shell is fitted with a series of plates which function, together with the teeth 33 on roll 32 to break up stone, pieces of pavement, pieces of frozen earth, etc., shown in FIG. 4 at 41. Each set of plates comprises a fracture board 50 reinforced by a wear plate 51 and braced by a plate 52. These plates are secured to each other and to the shell 30 by welding, bolts, or other suitable means. The clearance between the teeth 33 and the plates 50, 51 is such that a stone (by way of example) that is too large to pass between the teeth and the plate is, of necessity, broken into smaller pieces. The staggered arrangement of the teeth 33 and the multiplicity of sets of plates 50, 51, 52 are such that all or substantially all larger pieces are broken up to the proper size.

Figure 3:
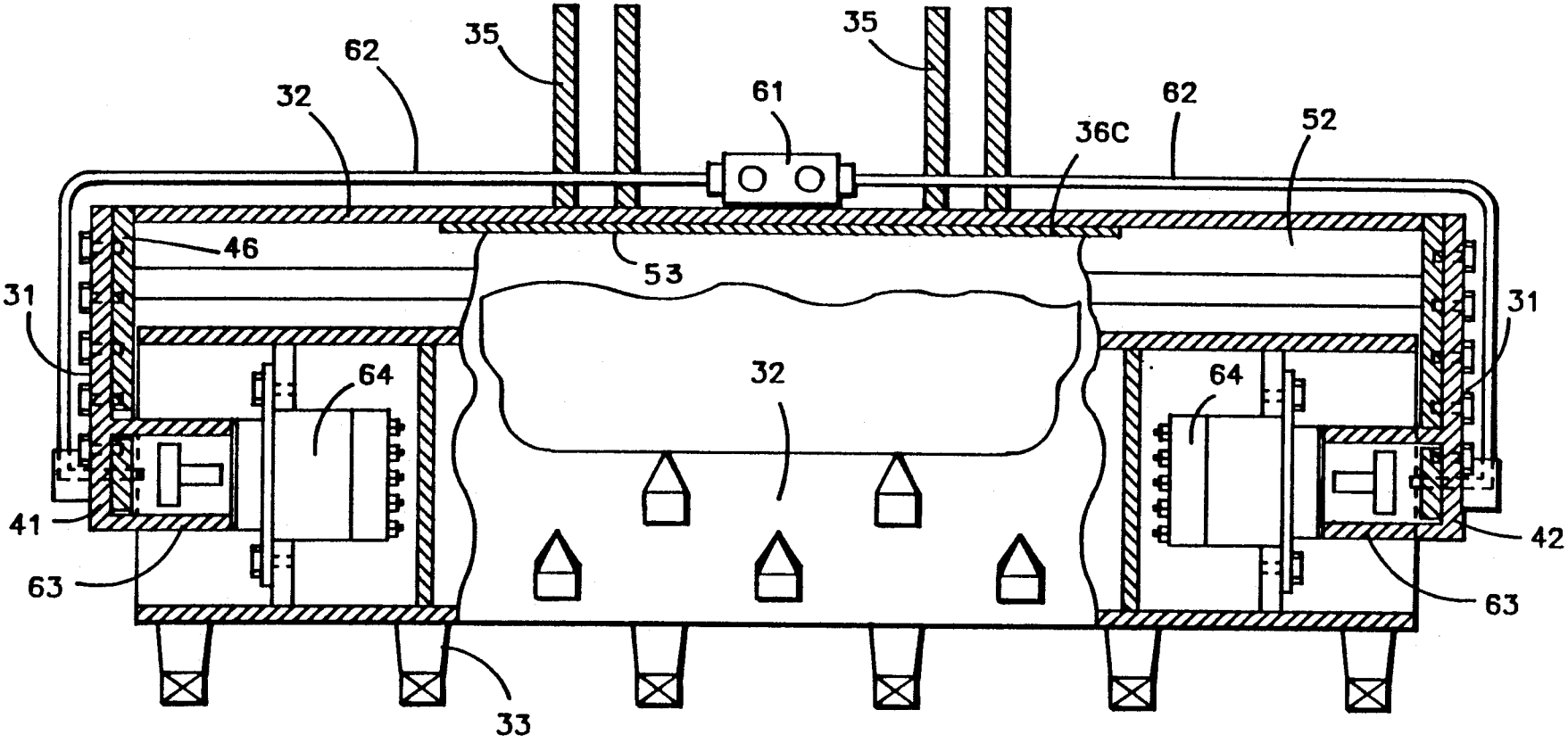
FIG. 3 is a front elevation, partially broken away, of the rotary mill attachment.

There are also provided wear plates 53 bent to conform to the shape of the shell 30. These plates are replaceable, being replaceably secured to the shell 30, e.g., by welding or by bolts and they do not extend the full length of the shell but are located in the central portion of the shell 30 (i.e., inwardly with respect to the ends of the shell) where wear is the greatest. This positioning of the wear plates is shown in FIG. 3. The wear plates 53 may be of suitable wear resistant steel construction, e.g., of T1 or AR steel.

Referring to FIGS. 1, 2, and 3, hydraulic lines 31 (see FIG. 1) circulate hydraulic fluid through a manifold 61 and lines 62 to hydrostatic motors 63, (there being one at each end of the shell 30 mounted on an end plate 31) which in turn drive torque drives 64 which are mounted on the roll 32. The torque drives function as gear reducing means to rotate the cutter roll 26 at the desired speed.

As shown in FIG. 4, as the machine 10 moves from left to right as viewed in this figure, and as the roll 32 rotates counterclockwise, pieces of pavement, frozen earth, or rocks 41 are uprooted from the ground G (and are formed by fracturing by teeth 33) and are carried up past the breaker plates.

It will be apparent that by disengaging the assembly 30 and reconnecting it from the other side, the machine may be operated in the reverse direction. The roll 32 will continue to rotate in counterclockwise direction as viewed in FIG. 1 but will be pushed instead of pulled and the equipment 10 will travel over processed material.

It will therefore be apparent that a new and useful earth working apparatus has been provided.

We claim:

1. A machine capable of breaking up pieces of stone, pavement and frozen earth comprising:

(a) a vehicle equipped to traverse the ground and having means to power and operate ground-breaking equipment, said vehicle having a front end and a rear end;

(b) a ground breaking assembly;

(c) means mounting said assembly at the front end of said vehicle for movement with the vehicle and for pivoting between a lowered ground engaging position and a raised transport position;

(d) said assembly comprising the following components:

(1) a cylinder supported with its cylindrical axis horizontal and for rotation about its cylinder axis;

(2) teeth mounted on the cylinder surface of said cylinder capable of digging into the earth, dislodging stones or other hard material and carrying the resulting dislodged fragments in an arcuate path about the cylinder axis;

(3) a shield partly surrounding said cylinder and so positioned and spaced form the cylinder that fragments dislodged by said teeth are trapped between the cylinder and the shield and (4) fracture boards mounted on the inner surface of said shield, the positions, dimensions and structure of such fracture boards being such that they will contact and fragment solid pieces of earth, stone or pavement as such pieces are picked up and moved by the cylinder and its teeth and (5) wear plates secured to the fracture boards, such wear plates being replaceable when worn.

2. The machine of claim 1 in which the mounting of said assembly (b) on said vehicle (a) is such that it can be readily attached to the front end of a loader, grader or scraper by detaching the loader, grader or scraper assembly and attaching said assembly (b), said assembly (b) being also readily detachable from the vehicle for reattachment of a loader, scraper or grader assembly.

3. The machine of claim 1 or claim 2 in which there are wear plates secured to the inner surface of the shield.

* * * * *